US006446370B1

(12) United States Patent
Ostermaier

(10) Patent No.: US 6,446,370 B1
(45) Date of Patent: Sep. 10, 2002

(54) IRONING DEVICE

(75) Inventor: Albert Ostermaier, Stein/Traun (DE)

(73) Assignee: BSH Bosch und Siemens Hausgerate GmbH, Munich (DE)

( * ) Notice: Subject to any disclaimer, the term of this patent is extended or adjusted under 35 U.S.C. 154(b) by 0 days.

(21) Appl. No.: 09/904,359

(22) Filed: Jul. 12, 2001

(30) Foreign Application Priority Data

Jul. 12, 2000 (DE) ..... 100 33 753

(51) Int. Cl.[7] ..... D06F 75/12; D06F 75/14
(52) U.S. Cl. ..... 38/77.6
(58) Field of Search ..... 38/77.6, 77.1, 38/77.3, 77.5, 77.9, 137; 219/246, 259

(56) References Cited

U.S. PATENT DOCUMENTS 2,817,169 A * 12/1957 Schott ..... 38/77.1
4,532,412 A * 7/1985 Birocchi ..... 38/77.9
4,535,556 A * 8/1985 Cavalli ..... 38/77.6
5,842,295 A * 12/1998 Ching et al. ..... 38/77.6

FOREIGN PATENT DOCUMENTS

JP 319750 * 8/1988 ..... 38/77.6
JP 3203196 * 8/1988 ..... 38/77.1

* cited by examiner

*Primary Examiner*—Ismael Izaguirre
(74) *Attorney, Agent, or Firm*—Laurence A. Greenberg; Werner H. Stemer; Gregory L. Mayback

(57) ABSTRACT

An ironing device includes a housing, a receptacle holding fluid, and a pumping device for transporting the fluid from the receptacle onto an ironing article. The receptacle is fluidically connected to the housing and the pumping device is disposed in the housing, is fluidically connected to the receptacle, and has at least one hose pump for pumping the fluid.

18 Claims, 2 Drawing Sheets

IRONING DEVICE

BACKGROUND OF THE INVENTION

Field of the Invention

The invention relates to an ironing device having a housing and a pumping device for transporting fluid from a receptacle onto an ironing article.

German Patent 198 29 675 A1 discloses an ironing device with a housing in which is disposed a pumping device with a diaphragm pump. The diaphragm pump has a pump chamber whose volume can be varied by a pump element. A feeder having a return valve is led from a receptacle integrated into the housing to the pump chamber and a pressure pipe having a return valve is led from the pump chamber to a spray nozzle. The pump element can be operated by an operating part, with the operating part being fashioned as a ductile diaphragm. The diaphragm pump can transport fluid from the receptacle through the spray nozzle onto an ironing article.

SUMMARY OF THE INVENTION

It is accordingly an object of the invention to provide an ironing device that overcomes the hereinafore-mentioned disadvantages of the heretofore-known devices of this general type and that creates a constructively simple ironing device having few locations between a receptacle and an outlet of a fluid that are simple to seal.

With the foregoing and other objects in view, there is provided, in accordance with the invention, an ironing device, including a housing, a receptacle holding fluid, and a pumping device for transporting the fluid from the receptacle onto an ironing article. The receptacle is fluidically connected to the housing. The pumping device is disposed in the housing, is fluidically connected to the receptacle, and has at least one hose pump for pumping the fluid.

Particularly few locations, which are simple to seal, between the receptacle and an outlet of the fluid can be reached with a hose pump when a single-piece hose is led from the receptacle through a pump part of the hose pump to a connection of a spray nozzle and/or a single-piece hose is led from a receptacle through a pump part of the hose pump to a connection of a steam chamber. The configuration provides a corresponding reduction in sealing outlay, additional components, assembly space, weight, assembling outlay, and costs.

The invention prevents pump parts, apart from the hose, from coming in contact with the fluid by providing moving displacers and bearings thereof to act upon the hose and thereby effect a pumping action. Such hose pumps are safe to run dry or, respectively, can be operated without fluid without causing damage. Such pumps are also particularly reliable.

Given hose pumps, scaling can be mostly prevented in the area of the pump. The hose coming in contact with the fluid is always set free from lime as a result of its motion or, respectively, deformation, and the hose protects the other pump parts from the fluid. Furthermore, hose pumps can obtain a desired conveying capacity in a constructively simple way through a hose cross-section. The hose pump forms a regenerative or self-priming system, so that a constant conveying capacity can be obtained independently of a level in the receptacle.

The hoses can be simply and flexibly laid in the housing, so that a particularly simple installation is possible. The hose can be produced from different materials appearing expedient to someone skilled in the art, with the hose being particularly made of flexible, conventional plastics. Silicone hoses are preferably utilized because water is typically used for moistening the ironing article.

In accordance with another feature of the invention, the receptacle can be disposed in the housing and/or outside the housing. A separate external receptacle can be fashioned with a large volume particularly for large amounts of ironing articles. A hose provided for a separate receptacle can be led to a connecting point that is integrated into the housing of the ironing device, whereby a hose of a separate receptacle can be connected to the connecting point. However, it is also possible that a sufficiently long hose to a separate receptacle already is disposed in the housing. The hose can be disposed in a retaining space in the housing, so that it can be wound up and unwound on a rotatable axle.

In accordance with a further feature of the invention, the at least one hose pump has a pump part, the housing has a spray nozzle with a nozzle connection, and at least one single-piece hose fluidically connects the receptacle to the nozzle connection through the pump part.

Instead of guiding a number of single-piece hoses from the receptacle through a pump part of the hose pump, it is also generally possible to provide a number of hoses and/or channels at a branch point with fluid by a hose led through the pump part, for example, a hose led from the receptacle through the pump part can provide for a channel branch point, which is integrated into the housing and can be controlled by an operator, whereby, proceeding from the channel branch point, individual outlets can be provided with fluid via a channel system integrated into the housing.

In accordance with an added feature of the invention, the housing has a steam chamber with a chamber connection, the at least one single-piece hose is at least two single-piece hoses, and at least one of the two single-piece hoses fluidically connects the receptacle to the chamber connection through the pump part.

In accordance with an additional feature of the invention, the at least one hose pump has a pump part, the housing has a steam chamber with a chamber connection, and at least one single-piece hose fluidically connects the receptacle to the chamber connection through the pump part.

In accordance with yet another feature of the invention, the receptacle is separate from the housing, the at least one hose pump has a pump part, and at least one hose is fluidically connected to the separate receptacle through the pump part.

In accordance with yet a further feature of the invention, at least one single-piece hose has a hose part and fluidically connects the receptacle to the pumping device through the pump part at a hose part, and the at least one hose pump has at least one displacer rolling off onto the hose part.

Given hose pumps, a pumping action is generally achieved in that driven displacers act upon a hose. The displacers can perform different movements that appear expedient to someone skilled in the art, for example, a displacer of a hose diaphragm pump having a return valve in flow direction in front of the displacer and a return valve in flow direction behind the displacer can execute a translational rocking motion perpendicular to the axis of the hose.

In accordance with yet an added feature of the invention, at least one displacer is at least two displacers, and one of the two displacers prevents a backflow of the fluid into the receptacle.

Hose pumps having at least one displacer rolling off onto a hose part are particularly advantageously utilized. As a result of the rolling motion of the displacer carried out on the hose part, a flow direction can be determined, so that at least one return valve can be foregone vis-à-vis the previously described hose diaphragm pump. If the hose pump has at least two displacers, advantageously, three or more displacers, one displacer always can be used for preventing a backflow into the receptacle, return valves can be completely foregone, and a particularly simple and cost-efficient hose pump can be obtained.

In accordance with yet an additional feature of the invention, at least one part of the hose pump is extrusion-coated given the production of the housing, namely a bearing component of at least one displacer, which is normally fashioned in a fixed manner relative to the housing. Additional mounting parts can be foregone and the assembling outlay, the weight, and the expenses can be reduced. Furthermore, additional components can be omitted by fashioning at least one part of the hose pump as one piece with the housing. A bearing component of at least one displacer is particularly advantageous for such a purpose.

In accordance with again another feature of the invention, at least a part of the at least one hose pump is formed in one piece or integral with the housing.

In accordance with again a further feature of the invention, the at least one displacer has a bearing component formed in one piece with the housing.

In accordance with again an added feature of the invention, the at least one hose pump has at least one part produced from plastic.

If at least one part of the hose pump or preferably the entire hose pump is composed of plastic, it can be particularly simply and cost-efficiently realized. Moreover, it is advantageous to fashion individual components as one piece with the housing that normally is produced from plastic.

In accordance with a concomitant feature of the invention, there is provided a motor connected to the at least one hose pump for operating the at least one hose pump.

An operation can manually operate the hose pump or, more advantageously, a motor can operate the hose pump, particularly, an electromotor, so that high operating comfort can be achieved.

Other features that are considered as characteristic for the invention are set forth in the appended claims.

Although the invention is illustrated and described herein as embodied in an ironing device, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
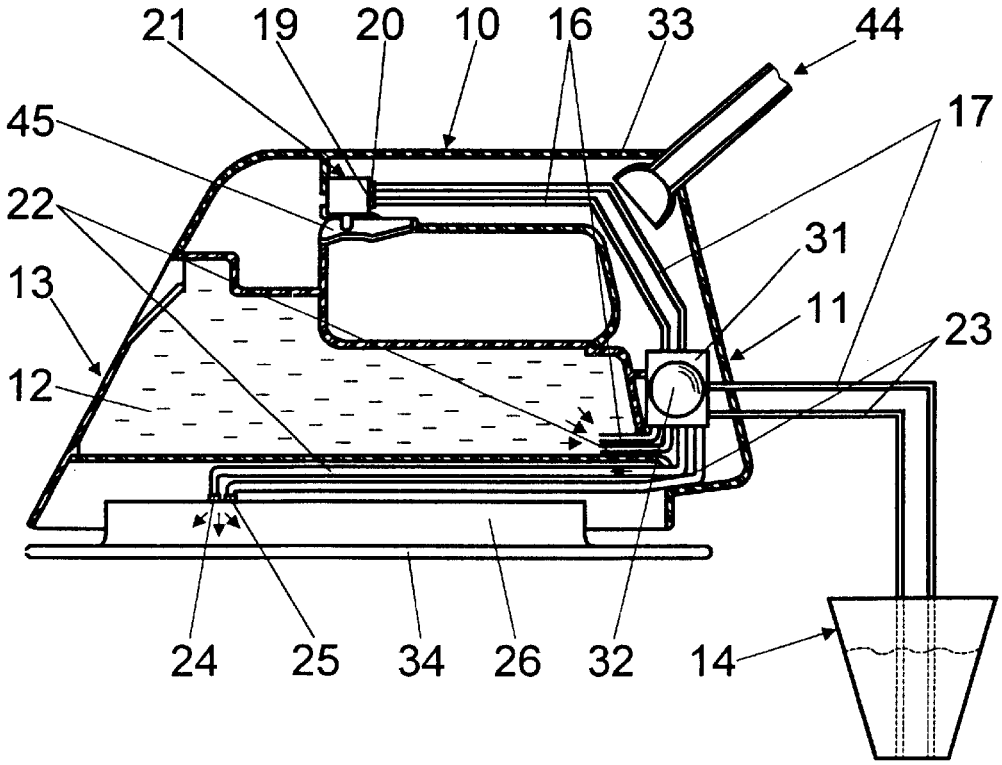
FIG. 1 is a cross-sectional view of an ironing device according to the invention.

In all the figures of the drawing, sub-features and integral parts that correspond to one another bear the same reference symbol in each case.

Referring now to the figures of the drawings in detail and first, particularly to FIG. 1 thereof, there is shown a schematically represented ironing device having a plastic housing 10 that is attached to a heatable metal ironing sole 34. A handle 33 is molded onto a side of the housing 10 opposite the ironing sole 34. A receptacle 13 is integrated into the housing 10 above the ironing sole 34 in the direction of the handle 33. A pumping device 11 also is disposed in the housing 10 through which liquid 12, particularly water, can be transported from the container 13 and/or a separate container 14 onto an ironing article.

Figure 2:
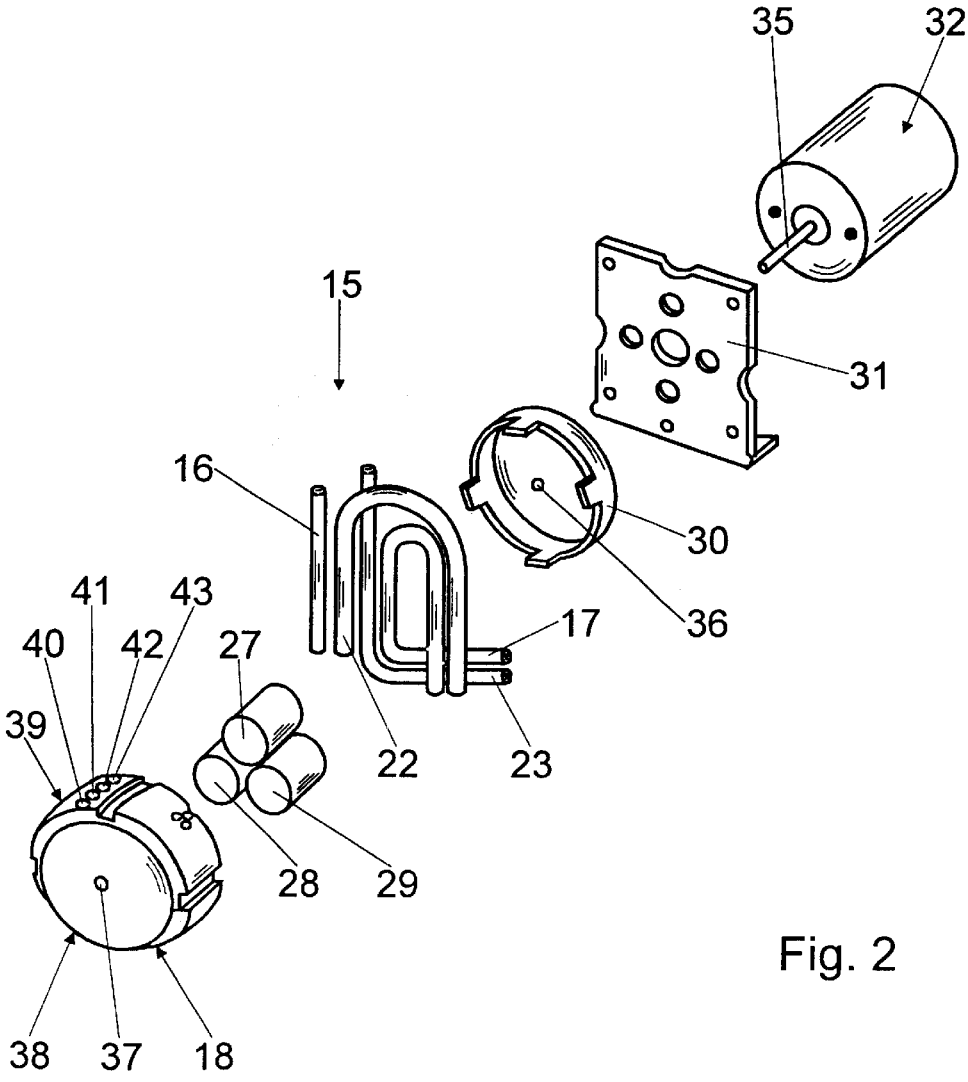
FIG. 2 is an enlarged, exploded, perspective view of a pumping device of FIG. 1.

The pumping device 11 inventively has a hose pump 15 (FIG. 2). A first single-piece silicone hose 16 is led from the receptacle 13 through a pump part 18 of the hose pump 15 to a connection 19 of a spray nozzle 21 and a second single-piece silicone hose 22 is led through the pump part 18 of the hose pump 15 to a connection 24 of a steam chamber 26. The steam chamber 26 is disposed directly above or, respectively, on the side of the ironing sole 34 facing the handle 33. A press switch 45 integrated at the handle 33 can operate the spray nozzle 21.

A third single-piece silicone hose 17 is led from the receptacle 14 through the pump part 18 of the hose pump 15 to a connection 20 of the spray nozzle 21 and a fourth single-piece silicone hose 23 is led through the pump part 18 of the hose pump 15 to a connection 25 of the steam chamber 26.

The pump part 18 is firmly connected to the housing 10 through a cover 30 and through a flange 31 that is screwed down with the housing 10. It is also possible to realize the pump part as one piece with a housing of the ironing device. Three cylindrical displacers 27, 28, 29 are disposed in the pump part 18, are driven by an electromotor 32, and can be rolled off onto the four silicone hoses 16, 17, 22, 23 for generating a pumping action. The electromotor 32 is provided with current through non-illustrated current cables that are led through a cable channel 44 into the housing 10 to the electromotor 32.

The electromotor 32 has a motor shaft 35, which, in a mounted state, is led through a first bearing 36 in the cover 30, through a middle area past the three cylindrical displacers 27, 28, 29, and through a second bearing 37 in the pump part 18. The motor shaft 35 drives the displacers 27, 28, 29 in a frictionally engaged fashion, namely, comparable to a sun wheel driving a planet. The pump part 18, the displacers 27, 28, 29, the cover 30, and the flange 31 are fashioned preferably as plastic molded parts.

The silicone hoses 16, 17, 22, 23 are led through four non-illustrated openings at a bottom side 38 of the pump part 18 into the pump part 18, are disposed adjacent one another at an inside wall of the pump part 18 to an upper side 39 and through four openings 40, 41, 42, 43 out of the pump part 18. The displacers 27, 28, 29 roll off onto the inside wall through the silicone hoses 16, 17, 22, 23 and generate a squeezing motion of the silicone hoses 16, 17, 22, 23 continuing in flow direction or, respectively, press the silicone hoses 16, 17, 22, 23 flat against the inside wall. Prior to a displacer 27, 28, or 29 being lifted off by the silicone hoses 16, 17, 22, 23, a following displacer 27, 28, or 29 presses the silicone hoses 16, 17, 22, 23 flat against the inside wall of the pump part 18, so that the fluid cannot flow back into the receptacle 13 or, respectively, 14.

I claim:

1. An ironing device, comprising:

a housing;

a receptacle holding fluid, said receptacle fluidically connected to said housing; and a pumping device for transporting the fluid from said receptacle onto an ironing article, said pumping device disposed in said housing, fluidically connected to said receptacle, and having at least one hose pump for pumping the fluid.

2. The ironing device according to claim 1, wherein:

said at least one hose pump has a pump part;

said housing has a spray nozzle with a nozzle connection; and at least one single-piece hose fluidically connects said receptacle to said nozzle connection through said pump part.

3. The ironing device according to claim 2, wherein:

said housing has a steam chamber with a chamber connection;

said at least one single-piece hose is at least two single-piece hoses; and at least one of said two single-piece hoses fluidically connects said receptacle to said chamber connection through said pump part.

4. The ironing device according to claim 1, wherein:

said at least one hose pump has a pump part;

said housing has a steam chamber with a chamber connection; and at least one single-piece hose fluidically connects said receptacle to said chamber connection through said pump part.

5. The ironing device according to claim 1, wherein:

said receptacle is separate from said housing;

said at least one hose pump has a pump part; and at least one hose is fluidically connected to said separate receptacle through said pump part.

6. The ironing device according to claim 1, wherein:

at least one single-piece hose has a hose part and fluidically connects said receptacle to said pumping device through said pump part at a hose part; and said at least one hose pump has at least one displacer rolling off onto said hose part.

7. The ironing device according to claim 6, wherein:

said at least one displacer is at least two displacers; and one of said two displacers prevents a backflow of the fluid into said receptacle.

8. The ironing device according to claim 7, wherein said one of said two displacers always prevents a backflow of the fluid into said receptacle.

9. The ironing device according to claim 1, wherein at least a part of said at least one hose pump is extrusion-coated given the production of the housing.

10. The ironing device according to claim 1, wherein at least a part of said at least one hose pump is formed in one piece with said housing.

11. The ironing device according to claim 1, wherein at least a part of said at least one hose pump is integral with said housing.

12. The ironing device according to claim 6, wherein said at least one displacer has a bearing component formed in one piece with said housing.

13. The ironing device according to claim 1, wherein said at least one hose pump has at least one part produced from plastic.

14. The ironing device according to claim 1, wherein at least one hose pump has at least one plastic part.

15. The ironing device according to claim 1, including a motor connected to said at least one hose pump for operating said at least one hose pump.

16. The ironing device according to claim 1, wherein said receptacle is disposed in said housing.

17. The ironing device according to claim 1, wherein said receptacle is disposed outside said housing.

18. The ironing device according to claim 1, wherein at least a part of said at least one hose pump is co-molded during the production of the housing.

* * * * *